US008042403B2

(12) United States Patent
Kerns

(10) Patent No.: US 8,042,403 B2
(45) Date of Patent: Oct. 25, 2011

(54) APPARATUS TO CONTROL A LINEARLY DECREASING FORCE

(75) Inventor: Keith A. Kerns, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 316 days.

(21) Appl. No.: 12/246,868

(22) Filed: Oct. 7, 2008

(65) Prior Publication Data

US 2010/0083734 A1 Apr. 8, 2010

(51) Int. Cl.
*G01B 5/30* (2006.01)

(52) U.S. Cl. ..... 73/760

(58) Field of Classification Search ..... 73/760
See application file for complete search history.

(56) References Cited

U.S. PATENT DOCUMENTS

| | | | | |
|---|---|---|---|---|
| 3,263,511 | A * | 8/1966 | Wellstein | 74/53 |
| 4,265,141 | A * | 5/1981 | Bowman | 74/516 |
| 5,433,656 | A * | 7/1995 | Cloutier et al. | 451/156 |
| 7,143,850 | B2 * | 12/2006 | Takenaka et al. | 180/8.6 |
| 7,540,799 | B1 * | 6/2009 | Trojan | 451/8 |

* cited by examiner

*Primary Examiner* — Lisa Caputo
*Assistant Examiner* — Octavia Davis
(74) *Attorney, Agent, or Firm* — Schwegman, Lundberg & Woessner, P.A.

(57) ABSTRACT

An apparatus provides a linearly decreasing force. The apparatus includes a plurality of links, which can be referred to as swing, seat, fixed, and input/output links. A spring is coupled to each of the seat links, and a rod is positioned in proximity to each spring and through each of the seat links. A load applied to the input/output link will experience a linearly decreasing resistance.

16 Claims, 3 Drawing Sheets

APPARATUS TO CONTROL A LINEARLY DECREASING FORCE

STATEMENT OF GOVERNMENT INTEREST

This invention was made with United States Government support under contract number F34601-02-C-0090 with the Department of the Air Force. The United States government has certain rights in this invention.

TECHNICAL FIELD

The present invention relates to force control mechanisms, and in an embodiment, but not by way of limitation, a mechanism to control a linearly decreasing force.

BACKGROUND

In the testing of certain devices and apparatuses, the test requires the application or provision of a linearly increasing force. In many of these circumstances, a simple compression coil spring or a spring-loaded test device can be used to provide such a linearly increasing force. However, in other situations, such as in the testing of pyro cartridges or the matching of an aerodynamic loading condition, testing requires a linearly decreasing force. Such a linearly decreasing force cannot be provided by a simple spring. The art is therefore in need of a test apparatus that can supply a linearly decreasing force.

DETAILED DESCRIPTION

Figure 1:
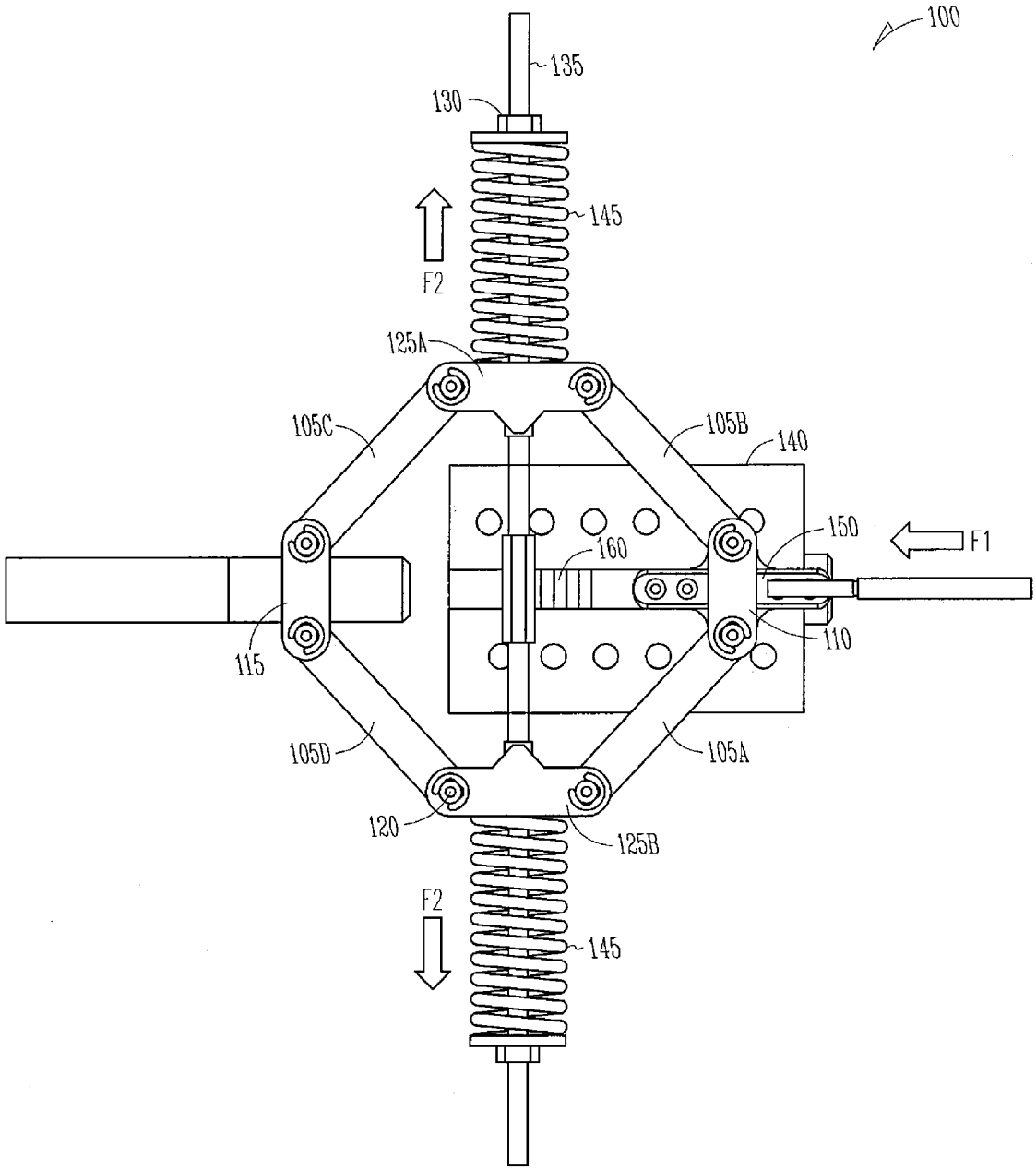
FIG. 1 illustrates an example embodiment of an apparatus that provides a linearly decreasing force.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIG. 1 illustrates an example embodiment of an apparatus 100 that provides a linearly decreasing force. The apparatus 100 consists of four equal length swing links 105*a*, 105*b*, 105*c*, and 105*d*, with each end of each swing link containing a low friction or other type of bearing 120. A fixed link 115 couples together swing links 105*c* and 105*d*. Opposite the fixed link 115 is an input/output link 110, which couples together swing links 105*a* and 105*b*. Two spring seat links 125*a* and 125*b* couple together swing links 105*b*, 105*c* and 105*a*, 105*d* respectively. The structure 100 of the four swing links 105*a-d*, the two spring seat links 125*a,b*, the fixed link 115, and the input/output link 110 forms an octagon. The spring seat links 125*a,b*, along with a spring preload adjustment nut 130, each hold a compression spring 145 in position. It is noted that shims or other methods of adjusting pre-load could be used. The spring seat links 125*a,b* are joined by a rod 135 that is free to slide through the spring seat links 125*a,b*. The rod 135 serves multiple functions. It provides a reaction point for the opposite ends of the springs 145, allows for adjustable preload to the springs, allows the force between the springs to balance, and constrains the spring seat links 125*a,b* to remain parallel to each other. The input/output link 110 is also attached to a load bearing assembly 140 that includes a linear bearing assembly 150. The linear bearing assembly 150 constrains the motion of the input/output link 110 so that the input/output link 110 remains parallel to the fixed link 115. The linear bearing assembly 150 also includes a ratchet mechanism 160 to restrain the linkage in the deployed position to eliminate spring-back of the linkage.

Figure 2:
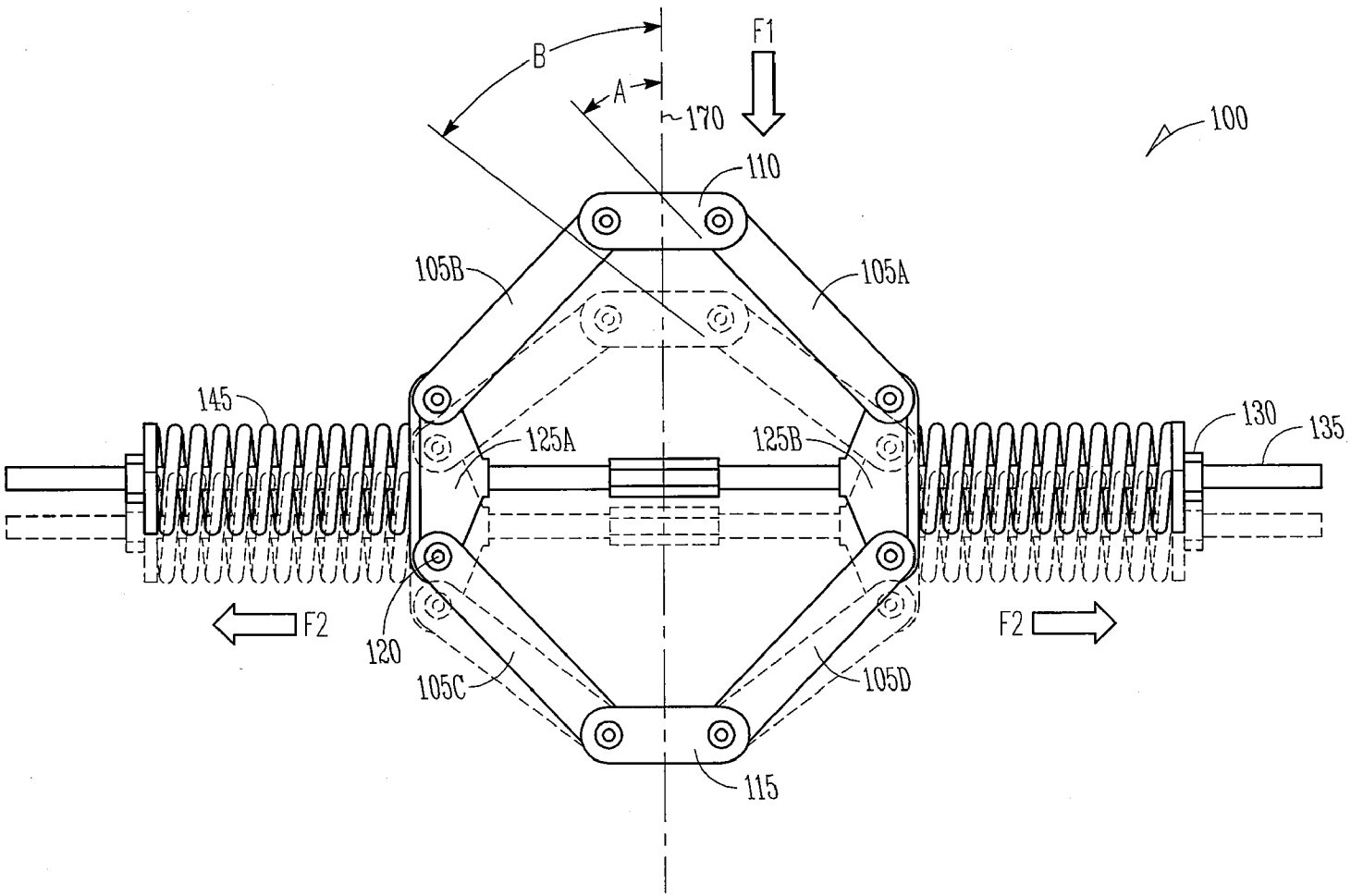
FIG. 2 illustrates the example embodiment of FIG. 1 in a rest position and in a position after a force has been applied.
Figure 3:
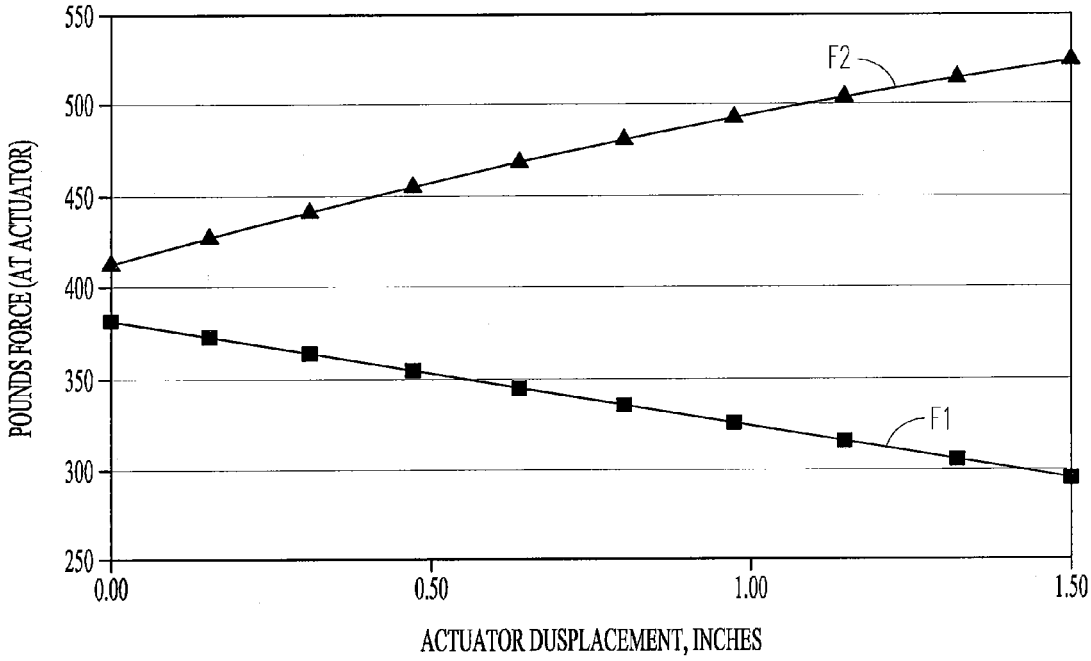
FIG. 3 is a graph illustrating a linearly decreasing input resistance versus a linearly increasing output resistance.

The swing links 105*a-d*, spring seat links 125*a,b*, fixed link 115, and input/output link 110, when a force F1 is applied to the input/output link 110 of the apparatus 100 via the load bearing assembly 140, as illustrated in FIG. 2, change angle magnitude and therefore vary mechanical leverage as the apparatus 100 moves through its range of motion. For example, at rest, the swing link 105*a* forms an angle A with a line 170 bisecting the apparatus 100 through its input/output link 110. After application of a force F1, the link system causes the angle formed by the swing link 105*a* and the bisecting line 170 to increase in magnitude to angle B. While the force F2 increases as the spring 145 compresses, the force F1 linearly decreases. The selection of link length, spring rate, spring preload, and initial and final angles are determined from the input forces and range of travel required. A resulting resistant force curve 300 is illustrated in FIG. 3. FIG. 3 illustrates the linearly decreasing force F1 and the linearly increasing force F2.

Figure 4:
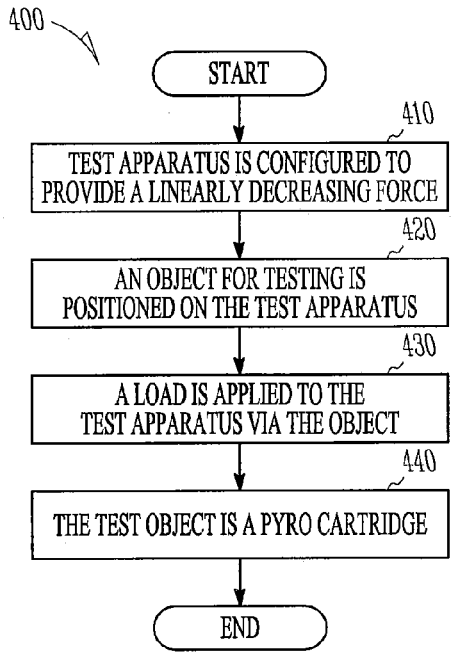
FIG. 4 is a flowchart of an example process for the provision of a linearly decreasing force to test an object.

FIG. 4 is a flowchart of an example process 400 to provide a linearly decreasing force in the testing of an object such as a pyro cartridge. At 410, a test apparatus is configured to provide a linearly decreasing force. At 420, an object for testing is positioned on the test apparatus. At 430, a load is applied to the test apparatus via the object. The test apparatus applies the linearly decreasing force to the test object by changing linkage angles of the test apparatus and thereby altering the leverage of the test apparatus. It is noted at 440 that the test object can be a pyro cartridge.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R. 1.72(b) to allow a reader to quickly ascertain the nature and gist of the technical disclosure. The Abstract is submitted with the understanding that it will not be used to interpret or limit the scope or meaning of the claims.

The invention claimed is:

1. An apparatus comprising:

a first, second, third, and fourth swing link;

a first and second seat link, a first end of the first seat link coupled to the first swing link and a second end of the first seat link coupled to the second swing link, and a first end of the second seat link coupled to the third swing link and a second end of the second seat link coupled to the fourth swing link;

a fixed link having a first end coupled to the first swing link and having a second end coupled to the fourth swing link;

an input/output link having a first end coupled to the second swing link and having a second end coupled to the third swing link;

a spring coupled to each of the first and second seat links;

a load bearing assembly coupled to the input/output link; and a rod positioned in proximity to each spring and each of the first and second seat links;

wherein a load applied to the load bearing assembly causes angles formed by the swing links, the seat links, the fixed link, and the input/output link to change in magnitude thereby varying a mechanical leverage of the apparatus and providing a linearly decreasing force in opposition to the load.

2. The apparatus of claim 1, comprising the load applied to the load bearing assembly.

3. The apparatus of claim 1, comprising one or more of a spring preload adjustment nut and a preload adjustment shim coupled to the rod, the spring preload adjustment nut and the preload adjustment shim configured to maintain a tension force on the spring.

4. The apparatus of claim 1, comprising a plurality of bearings coupling the swing links, the seat links, the fixed link, and the input/output link.

5. The apparatus of claim 1, wherein the first and second seat links comprise an opening to receive the rod.

6. The apparatus of claim 1, wherein the rod is axially positioned within each spring and through each of the first and second seat links.

7. The apparatus of claim 1, comprising a ratchet assembly, coupled to the input/output link, to eliminate a spring-back of the linkage.

8. The apparatus of claim 1, wherein the swing links, the seat links, the fixed link, and the input/output link form an octagon.

9. A system for testing a device comprising:

a first, second, third, and fourth swing link;

a first and second seat link, a first end of the first seat link coupled to the first swing link and a second end of the first swing link coupled to the second swing link, and a first end of the second seat link coupled to the third swing link and a second end of the second seat link coupled to the fourth swing link;

a fixed link having a first end coupled to the first swing link and having a second end coupled to the fourth swing link;

an input/output link having a first end coupled to the second swing link and having a second end coupled to the third swing link, the input/output link configured to receive the device for testing; and a spring coupled to each of the first and second seat links;

wherein a load applied to the load bearing assembly causes angles formed by the swing links, the seat links, the fixed link, and the input/output link to change in magnitude thereby varying a mechanical leverage of the apparatus and providing a linearly decreasing force in opposition to the load.

10. The system of claim 9, wherein the device is a pyro cartridge.

11. The system of claim 9, comprising a rod axially positioned within each spring and through each of the first and second seat links.

12. The system of claim 9, comprising a load bearing assembly coupled to the input/output link.

13. The system of claim 9, comprising one or more of a spring preload adjustment nut and a preload adjustment shim coupled to the rod.

14. The system of claim 9, comprising a plurality of bearings coupling the swing links, the seat links, the fixed link, and the input/output link.

15. The system of claim 9, wherein the swing links, the seat links, the fixed link, and the input/output link form an octagon.

16. An apparatus comprising:

means for receiving a load; and means for varying a mechanical advantage so that a linearly decreasing input force is applied to the load;

wherein the means for receiving a load comprises an input/output link; and wherein the means for varying the mechanical advantage comprises:

a first, second, third, and fourth swing link;

a first and second seat link, a first end of the first seat link coupled to the first swing link and a second end of the first seat link coupled to the second swing link, and a first end of the second seat link coupled to the third swing link and a second end of the second seat link coupled to the fourth swing link;

a fixed link having a first end coupled to the first swing link and having a second end coupled to the fourth swing link;

an input/output link having a first end coupled to the second swing link and having a second end coupled to the third swing link; and a spring coupled to each of the first and second seat links;

a load bearing assembly coupled to the input/output link; and a rod positioned in proximity to each spring and each of the first and second seat links;

wherein a load applied to the load bearing assembly causes angles formed by the swing links, the seat links, the fixed link, and the input/output link to change in magnitude thereby varying a mechanical leverage of the apparatus and providing a linearly decreasing force in opposition to the load.

* * * * *